United States Patent [19]

Tanel

[11] Patent Number: 4,577,422

[45] Date of Patent: Mar. 25, 1986

[54] ATHLETIC SHOE WITH IMPROVED PIVOT CLEATING

[76] Inventor: Michael L. Tanel, 119 N. 92nd St., Milwaukee, Wis. 53226

[21] Appl. No.: 565,746

[22] Filed: Dec. 27, 1983

[51] Int. Cl.[4] ..... A43B 5/02; A43B 5/00; A43C 15/16

[52] U.S. Cl. ..... 36/126; 36/128; 36/134; 36/59 C; 36/67 R

[58] Field of Search ..... 36/32 R, 126, 127, 128, 36/129, 134, 59 C, 67 R, 67 A

[56] References Cited

U.S. PATENT DOCUMENTS

| | | | |
|---|---|---|---|
| Re. 26,419 | 7/1968 | McAuliffe | 36/128 |
| 825,869 | 7/1906 | Sandeman | 36/132 |
| 844,057 | 2/1907 | Tillinghast | 36/132 |
| 1,552,022 | 9/1925 | Willson | 36/59 C |
| 1,736,576 | 11/1929 | Cable | 36/59 C |
| 2,261,785 | 11/1941 | Youmans | 36/134 |
| 2,365,027 | 12/1944 | Urbany | 36/59 C |
| 2,677,905 | 5/1954 | Dye | 36/128 |
| 2,678,507 | 5/1954 | Dye | 36/134 |
| 3,466,763 | 9/1969 | Levin | 36/126 |
| 3,707,047 | 12/1972 | Nedwick | 36/134 |

*Primary Examiner*—Werner H. Schroeder
*Assistant Examiner*—Steven N. Meyers
*Attorney, Agent, or Firm*—Peter N. Jansson, Ltd.

[57] ABSTRACT

An athletic shoe for field sports having a circular cleat formed on the sole in forward position substantially encompassing the ball-of-the-foot and toe portions of the sole, extending substantially across the width of the sole, and enclosing a surface coincident with the main surface of the sole. The shoe provides improved pivotability while also providing good traction, and can reduce the frequency of certain common leg injuries.

9 Claims, 6 Drawing Figures

ATHLETIC SHOE WITH IMPROVED PIVOT CLEATING

FIELD OF THE INVENTION

This invention is related generally to athletic shoes of the type having cleats, such as football shoes, and more specifically to athletic shoes with cleating accommodating pivoting movements.

BACKGROUND OF THE INVENTION

Most athletic shoes used for field sports, such as football, soccer, and lacrosse, have a number of tapered or blade-like cleats for the purpose of increasing traction. Cleats dig into the turf to prevent slipping during starting, stopping, and cutting maneuvers.

Such cleats, however, inhibit certain common pivoting actions, such as foot actions during the changing of directions. Indeed, such cleats make a player susceptible to injuries, particularly common knee injuries, if his leg is forcibly twisted when the cleats have penetrated well into the turf.

Attempts have been made in the past to make a cleated shoe which would accommodate pivoting movements and reduce the aforesaid injury problems. Examples of such prior attempts include the shoes shown in U.S. Pat. Nos. 1,072,794, 2,261,785, 2,677,905, and 3,816,945.

Some prior art athletic shoes, such as that shown in the last of these patents, have been designed to improve pivoting by providing a rotatable cleat. This approach presents a serious problem in that the rigors of field sports will easily damage such constructions. This approach, therefore, is deemed impractical in most cases. Some other prior patents, such as the first three of these patents, have disclosed fixed annular cleats. This invention relates generally to constructions of this latter type.

Shoes of the prior art which have included annular cleats have failed to provide adequate gripping action and/or have failed to provide adequate pivoting action for several specific reasons. Such shoes have not been accepted by athletes and have not been widely in use. The athletic shoe of this invention overcomes these problems.

The deficiencies of the prior art and the unique characteristics and advantages of this invention can most easily be described with reference to the foot of the athlete. The sole of the foot includes four basic portions. These are, in order back to front: the heel portion; the arch portion; the ball-of-the-foot portion; and the toe portion. The heel portion and the ball-of-the-foot portion are those portions which share most if not all of the player's weight when the player is in a normal standing position with his feet generally flat on the ground. In such position, the arch portion bears little if any weight, and the toe portion bears little if any weight.

When a player is "on his toes" in a "ready" position, virtually all of the player's weight is normally shared by the toe portion and the ball-of-the-foot portion. The same is usually true when a player is "digging" in a running action. Indeed, when a player is in the ready position the juncture of the phalanges (toe bones) and the metatarsles is the center of weight bearing. In other words, the center of weight bearing in the forward portions of the foot actually moves forward when a player shifts to the ready position.

The sole of an athletic shoe has portions immediately below such four foot portions which may be designated, and herein are designated, by the same terms.

Prior art shoes having annular cleating fail to function properly at least in part because of grossly improper placement of an annular cleat—much too far back from the juncture of the toe and ball-of-the-foot portions where weight is centered in the ready position. Indeed, in the ready position, normally the only position in which pivoting is important, such prior shoes would pivot little better than shoes with the standard blade-like or tapered cleats.

Further affecting the performance of at least some of such prior art shoes with annular cleats is the fact that a raised portion is enclosed by the annular cleat, thus preventing significant penetration of the turf and limiting the available traction. Another drawback of the prior art is the small width of such annular cleats, which in prior art cleating arrangements gives less than desirable pivoting and gripping.

Without further elaboration on the shortcomings of prior athletic shoes, it can be said that prior shoes have failed to provide a combination of good traction and good pivotability. Therefore, the standard cleated soles have continued in use, with the risks and occurrences of knee injuries and other injuries due to improper pivoting continuing substantially unabated. For years there has been a strong, unsatisfied need for an improved athletic shoe for field sports.

BRIEF SUMMARY OF THE INVENTION

This invention is an improved athletic shoe for field sports providing good traction without sacrificing pivotability. Stated differently, this invention provides improved pivotability without sacrificing traction.

The sole of the shoe of this invention includes a generally circular cleat forming a generally circular edge encompassing most of the ball-of-the-foot and toe portions of such sole. Such circular cleat is centered about the portion of the sole beneath the juncture of the phalanges and the metatarcles. Such circular cleat extends substantially across the width of the sole. Furthermore, such circular cleat encloses a sole area which is coincident with the main sole surface; that is, the enclosed sole surface is not at a level built up substantially from the main sole surface.

In certain preferred embodiments, the circular cleat is the forwardmost cleat on the shoe. In some embodiments, a central cleat preferably of the standard tapered frustoconical shape is disposed concentrically within the circular cleat. In some other embodiments, one or more circular cleats are disposed concentrically within the principal circular cleat.

The circular cleat or cleats preferably have a radially outer lateral surface projecting at substantially right angles from the main sole surface and an inner surface flaring outwardly from the main sole surface to be convergent with the outer surface. This configuration is highly preferred over a configuration in which the outer surface is flared inwardly, because the right-angled outer surface gives superior traction.

Greatly improved pivoting is possible using the shoes of this invention. This is demonstrated dramatically in certain common moves in football, such as the spinning movements of offensive running backs and defensive pass rushers and the "pulling" action of an offensive guard on sweeps and trap plays, to name just a few.

More generally, a wide variety of "moves" in many field sports are greatly facilitated and/or accelerated by the shoe of this invention, and innovative playing techniques are made possible. Prior athletic shoes have not provided the dramatic advantages which are provided by this invention.

And, as previously indicated, the frequency of certain common leg injuries can be reduced by use of this invention.

OBJECTS OF THE INVENTION

It is an object of this invention to provide an improved athletic shoe for field sports which will reduce the possibility of injuries, particularly knee injuries.

It is another object of this invention to provide an athletic shoe giving improved pivotability without sacrificing traction.

It is another object of this invention to provide an athletic shoe giving both good traction and good pivotability.

Yet another object of this invention is to provide an improved athletic shoe of the type specifically designed to accommodate the need to pivot.

Another object of this invention is to provide an athletic shoe of the type specifically designed for pivoting which allows easy pivoting when the foot is in the ready position with weight being borne by the toe and ball-of-the-foot portions.

These and other objects will be apparent from the following additional description including the drawings, wherein:

DETAILED DESCRIPTION OF PREFERRED EMBODIMENTS

FIGS. 1, 2, 4 and 5 show an athletic shoe 10 in accordance with a preferred embodiment of this invention. Shoe 10 has an upper 12 and a sole 14 affixed to upper 12 in the normal way.

Sole 14 is formed of a tough material, such as any of several materials widely used for tough cleated shoe soles, which can flex in the normal manner depending on how weight is applied thereto. The surface of sole 14 which contacts the playing surface includes a main sole surface 16 and a number of cleats which protrude therefrom. The cleats are preferably integrally formed with main sole surface 16, but may be separately formed and attached thereto.

Figure 2:
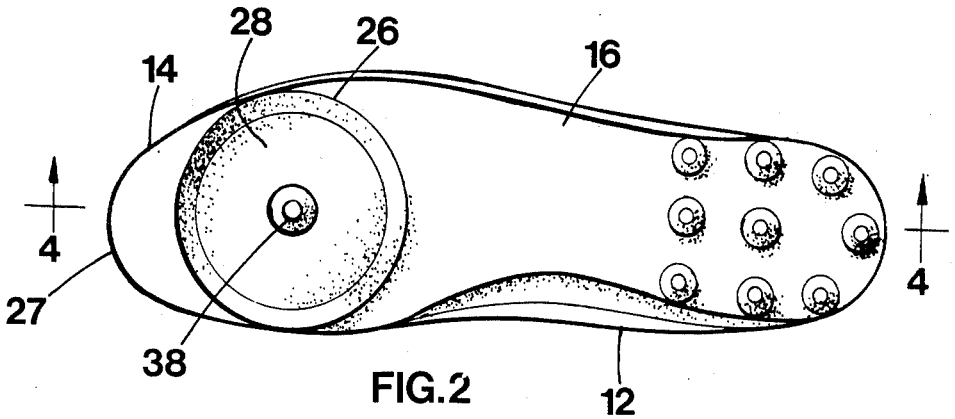
FIG. 2 is a plan view of FIG. 1.
Figure 3:
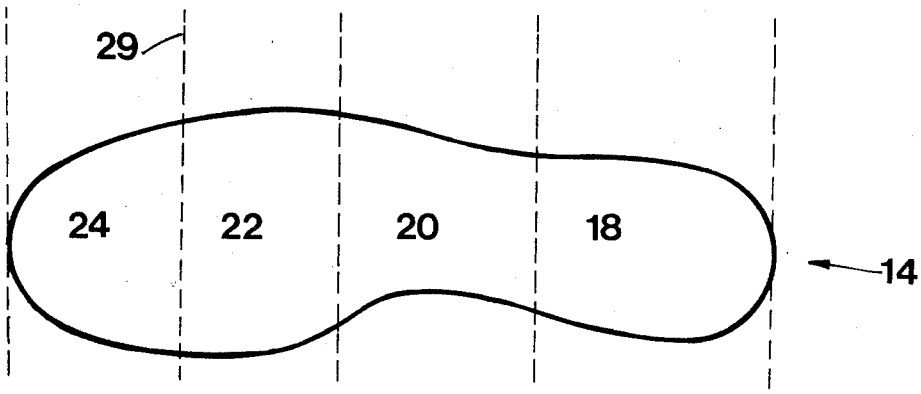
FIG. 3 is a cleatless schematic plan view of an athletic shoe sole, illustrating the portions thereof.
Figure 4:
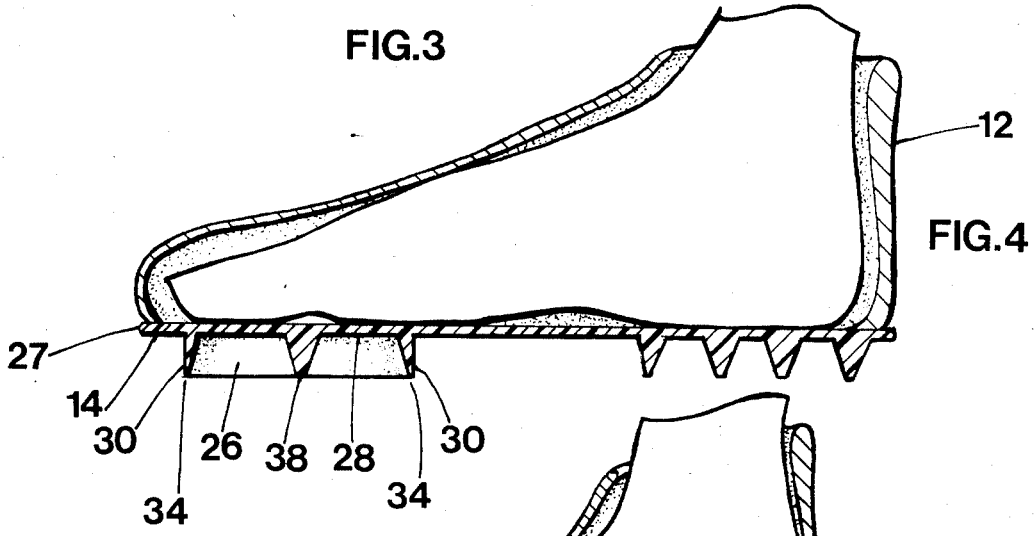
FIG. 4 is a sole-down sectional view, taken along section 4—4 as shown in FIG. 2, including a player's foot.
Figure 5:
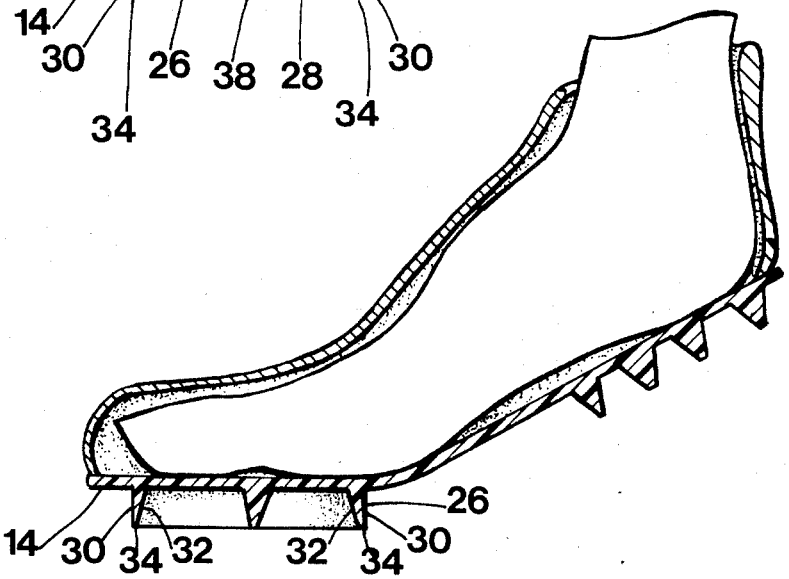
FIG. 5 is another sectional view as in FIG. 4, but illustrating the shoe and foot in the "ready" position.

As illustrated in schematic FIG. 3 and in FIGS. 2, 4 and 5, which are aligned in the drawing with schematic FIG. 3, sole 14 has four areas or portions which are defined by the portions of the foot adjacent to them. These include: a heel portion 18, immediately below the player's heel; an arch portion 20, below the arch of the player's foot; a ball-of-the-foot portion 22, below the ball of the player's foot; and a toe portion 24, below the player's toes. As previously noted, the ball of the foot is that portion which together with the heel bears weight when the player is standing in a flat-footed stance (FIG. 4), while the toe and ball-of-the-foot portions bear weight when the player is in the ready position (FIG. 5).

Circular cleat 26 protrudes from main sole surface 16 near the forward end 27 of sole 14. Circular cleat 26 substantially encompasses ball-of-the-foot and toe portions 22 and 24 of sole 14, and is centered at the juncture 29 thereof. Circular cleat 26 extends across the width of sole 14 and encloses a sole area 28 having a surface which is coincident with main sole surface 16.

Circular cleat 26 has a radially outer surface 30 which is normal (that is, approximately perpendicular) to main sole surface 16 and a radially inner surface 32 which is concentric with outer surface 30 and is flared outwardly toward outer surface 30. The angles of outer and inner surfaces 30 and 32 with respect to main sole surface 16 can vary, although the configuration described above is highly preferred for good traction.

Outer and inner surfaces 30 and 32 converge to meet in a sharp circular edge 34. The nature of the circular edge, that is, whether it is sharp or blunt, can vary regardless of the angles of outer and inner surfaces 30 and 32 relative to main sole surface 16. The outer and inner surfaces can converge in a sharp circular cleat edge as shown in the figures, or the cleat cross-section can have its top portion "cut off" to blunt the cleat to a greater or lesser degree. Just how sharp the circular cleat should be is dependent on the kind of playing surface on which the shoe will be used. Sharper circular cleats are appropriate for relatively hard playing surfaces, while blunter circular cleats may be acceptable on softer surfaces.

Likewise, the depth of the cleats may be chosen to accommodate the type of playing surface. For example, deeper (longer) cleats are preferred on natural turf, while shallower (shorter) cleats are better for most artificial turfs. In general, the circular cleats on the shoes of this invention are of a depth not unlike that of standard cleats of the prior art.

Edge line 34 is preferably in one plane and continuous, but it can have some undulations, minor discontinuities, or other irregularities such as would not significantly retard pivoting. Cleat 26 is preferably round; however, a slightly oval shape or other off-round shape would be within the scope of this invention as long as pivoting is facilitated.

Circular cleat 26 preferably extends completely across the width of sole 14. However, the circular cleat can be located slightly away from the edge of sole 14. In some cases, it may be desirable to make minor changes in the width of the sole to accommodate wider circular cleats.

Circular cleat 26 is flexible to the extent that it will not significantly interfere with the normal sole flexing during running or other foot movement. This provides a comfortable feeling and also helps to keep mud from collecting on main sole surface 16 in the area 28 encompassed by cleat 26.

Located concentrically within circular cleat 26 is a standard frusto-conical tapered cleat 38. Cleat 38 serves to provide increased traction, and because of its location will not interfere at all with pivoting. Indeed, cleat 38 may help define a center point for pivoting.

To the rear of circular cleat 26, in and/or near heel portion 18, are several standard tapered cleats 36. These are positioned so as not to interfere with pivoting when the foot and sole are in the ready (on toes) position. Instead of tapered cleats, bladed cleats, another circular cleat, or some other kinds of cleats could be used in the heel portion.

Figure 1:
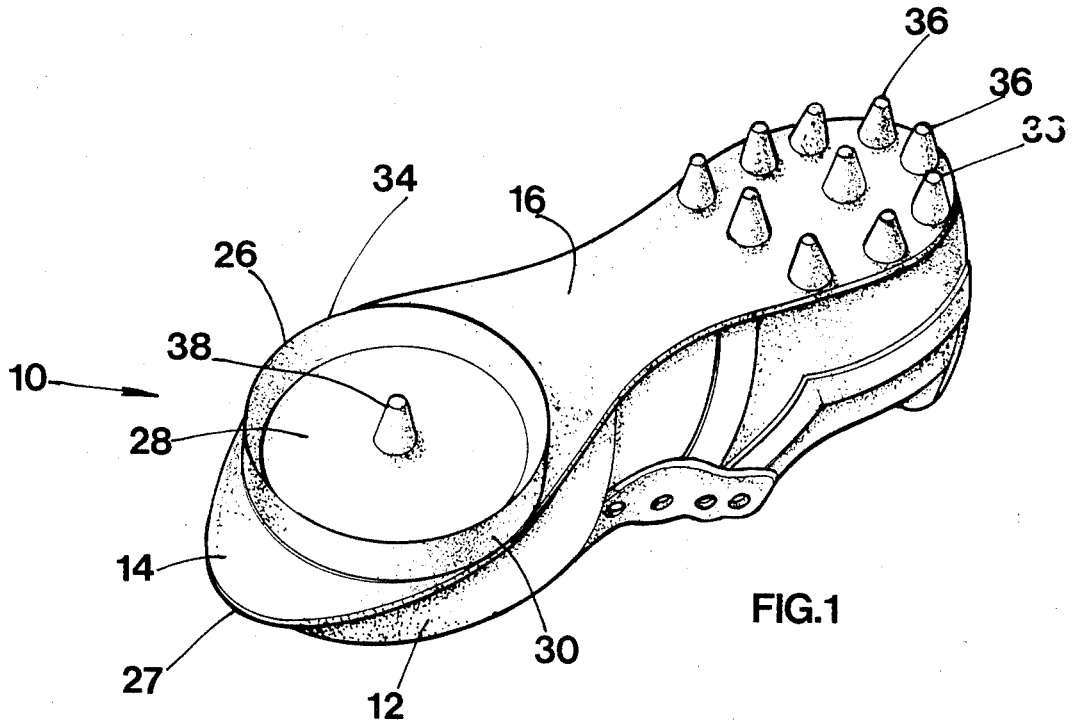
FIG. 1 is a sole-up perspective view of a preferred athletic shoe in accordance with this invention.
Figure 6:
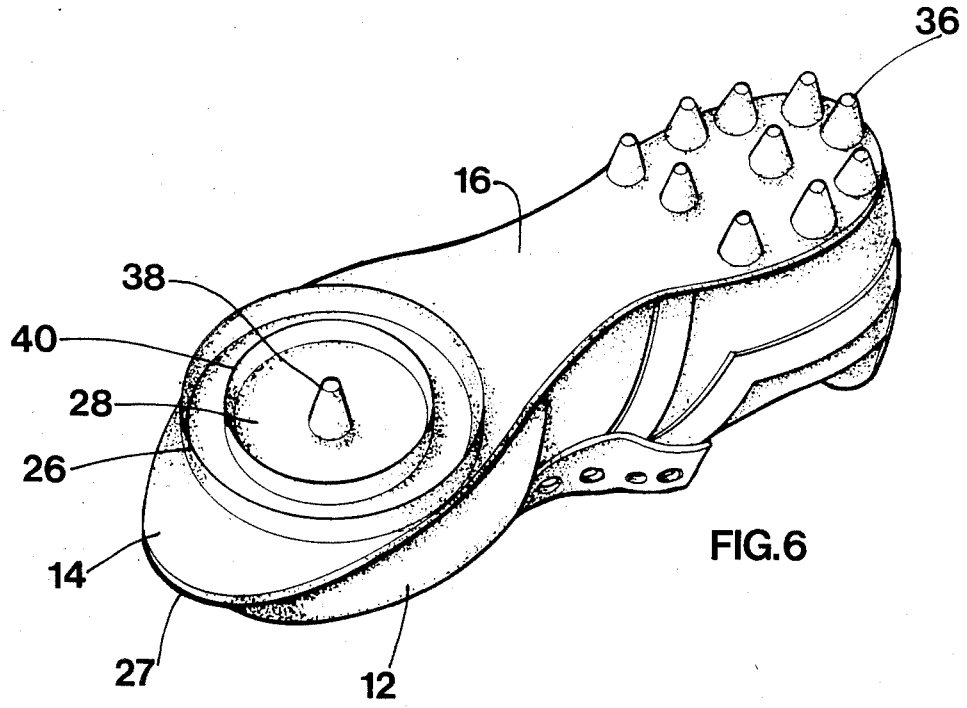
FIG. 6 is a sole-up perspective view, as in FIG. 1, illustrating another embodiment of this invention.

FIG. 6 illustrates another embodiment of this invention, including a second circular cleat 40 concentric with first circular cleat 26 and having a smaller radius. A multiplicity of circular cleats may be desirable in certain cases, such as on artificial turf, and will not retard pivotability.

It is preferred that circular cleat 26 be the forwardmost cleat. In some cases, however, a small cleat of a shape not retarding rotation can be placed forward of the circular cleat at the very tip of the toe portion. Any such cleat would have sharp lateral ends so as not to significantly retard pivoting and preferably would be concentric with the circular cleat. As long as the location of the circular cleat (or concentric circular cleats, as the case may be) remains in the position described herein, it is possible to have more than one (for example, two or even three) very small cleats at the tip of the toe portion, particularly for shoes intended for use on certain artificial turfs.

Acceptable materials for the sole of the shoe of this invention would be well known to those skilled in the shoe-making art. Various plastics, such as polyurethane and nylon, hard rubber, hardened leather, and the like, and even metal, are acceptable.

While the principles of this invention have been described in connection with specific embodiments, it should be understood clearly that these descriptions are made only by way of example and are not intended to limit the scope of the invention.

I claim:

1. In an athletic shoe of the type having a sole with a main sole surface and cleats extending therefrom to provide traction, such sole having a heel portion, an arch portion, a ball-of-the-foot portion, and a toe portion, the improvement comprising:

a cleat forming a substantially circular edge encompassing substantially the entire ball-of-the-foot and toe portions of the sole and extending across substantially the entire width thereof;

said cleat being flexible to allow flexing of the sole; and said cleat enclosing a sole area substantially all non-cleat portions of which are coincident with said main sole surface, said cleat having inner and outer annular surfaces angled with respect to said main sole surface and extending from said circular edge to intersection with said main sole surface, whereby both improved pivotability and traction are provided.

2. The athletic shoe of claim 1 wherein said circular cleat is the forwardmost cleat.

3. The athletic shoe of claim 1 further including a central cleat disposed concentrically within said circular cleat.

4. The athletic shoe of claim 1 wherein said circular cleat is a first circular cleat and further including a second substantially circular cleat located concentrically within said first-mentioned circular cleat.

5. The athletic shoe of claim 1 wherein said outer surface is substantially normal to said main sole surface.

6. The athletic shoe of claim 5 wherein said inner surface is flared outwardly toward said outer surface, converging therewith such that said circular edge is sharp

7. The athletic shoe of claim 2 further including a central cleat disposed concentrically within said circular cleat.

8. The athletic shoe of claim 7 wherein said outer surface is substantially normal to said main sole surface.

9. The athletic shoe of claim 8 wherein said inner surface is flared outwardly toward said outer surface, converging therewith such that said circular edge is sharp.

* * * * *